United States Patent [19]

Kuelzer et al.

[11] 4,155,661

[45] May 22, 1979

[54] MOUNTING ARRANGEMENT FOR ELECTROMAGNET DRIVING STRUCTURES IN A MOSAIC NEEDLE PRINTER HEAD

[75] Inventors: Peter Kuelzer, Munich; Richard Reier, Taufkirchen, both of Fed. Rep. of Germany

[73] Assignee: Siemens Aktiengesellschaft, Berlin & Munich, Fed. Rep. of Germany

[21] Appl. No.: 846,174

[22] Filed: Oct. 27, 1977

[30] Foreign Application Priority Data

Oct. 28, 1976 [DE] Fed. Rep. of Germany ..... 2649213

[51] Int. Cl.[2] ..... B41J 3/10

[52] U.S. Cl. ..... 400/124; 101/93.05

[58] Field of Search ..... 101/93.05; 335/255, 335/258, 262; 400/124

[56] References Cited

U.S. PATENT DOCUMENTS

| | | | |
|---|---|---|---|
| 3,729,079 | 4/1973 | Zenner, et al. | 101/93.04 X |
| 3,842,955 | 10/1974 | Iwasaki | 335/270 X |
| 3,882,985 | 5/1975 | Liles | 101/93.05 X |
| 3,889,793 | 6/1975 | Cattaneo | 101/93.05 X |
| 3,900,094 | 8/1975 | Larsen et al. | 101/93.05 X |
| 3,918,567 | 11/1975 | Kittredge | 101/93.04 X |
| 3,999,644 | 12/1976 | Pape et al. | 101/93.05 X |

FOREIGN PATENT DOCUMENTS

| | | | |
|---|---|---|---|
| 153938 | 1/1970 | Fed. Rep. of Germany | 400/124 |
| 2119417 | 11/1972 | Fed. Rep. of Germany | 400/124 |

*Primary Examiner*—Paul T. Sewell

*Attorney, Agent, or Firm*—Hill, Gross, Simpson, Van Santen, Steadman, Chiara & Simpson

[57] ABSTRACT

A mounting arrangement for the electromagnet driving structures in a mosaic needle printer head in which each electromagnet structure is mounted on a supporting member provided with recesses of generally cup-shaped configuration in each recess of which a electromagnet structure is disposed, and maintained in operative position by a spring element, means preferably being provided for effecting an adjustment of the electromagnet structure relative to the supporting member.

9 Claims, 4 Drawing Figures

MOUNTING ARRANGEMENT FOR ELECTROMAGNET DRIVING STRUCTURES IN A MOSAIC NEEDLE PRINTER HEAD

BACKGROUND OF THE INVENTION

The invention relates to a mounting arrangement for electromagnet driving structures in a mosaic needle printer head, in which such structures are adjustably mounted on a supporting frame, employing resilient elements and provided with a screw adjustment.

The invention is of particular utilization in recording or printing machines such as teletypewriters, office and data recording machines.

In the recording of characters upon a recording carrier, for example, of paper or the like, by means of mosaic needle printer heads, with or without the utilization of ink ribbons and the like, it is necessary to arrange the needle printer head at an optimum distance from the recording carrier. The precision of the adjustment of the distance from the recording carrier becomes of increased importance when a specific value is required for clean, even recording, particularly when high typing velocities are desired.

As the needle printer heads comprise a plurality of individual parts, it is necessary not only to take into consideration the adjustability of the head itself but also the adjustability of the spacing of the ends of the individual printer needles with respect to the printing or impression location. The length of the individual printer needle elements is subject to tolerance errors and the drive structures for the needle elements likewise involve mechanical tolerance errors. The various tolerances have different initial characteristics, the effects of which must be equalized or balanced by corrections in the distance between the printer needles and the impression points. Likewise, the wear of the impact ends of the printer needles is different in dependence upon the position of the printer needles within the printer head and in dependence upon their individual operating frequency, so that a corresponding subsequent adjustability is desirable.

These problems are known and arrangements have been devised taking these facts into consideration. Thus, for example, German Offenlegungsschrift No. 2,430,440=U.S. Pat. No. 3,907,092 discloses a construction in which the individual plunger type armature electromagnet structures are adjustably supported in the frame of a mosaic needle printer head by means of a threaded or screw connection. The mosaic needle printer head, utilizes plunger-type armature elements in the individual magneto structures with the latter being adjustable, in the displacement direction of their plunger-type armatures, by rotating the respective structures about the axes of their armatures, utilizing suitable threaded screw connections. The final adjusted position is maintained by the use of a suitable lock nut. However, in order to effect an adjustment of the individual magneto structures, it is necessary to disconnect the electrical connections thereto. Consequently, an adjustment of the structures during a test operation is not readily possible, complicating subsequent adjusting operations.

In a mosaic needle printer head utilizing a drop-type armature structure, it is known, for example, from German Offenlegungsschrift No. 2,256,813,=U.S. Pat No. 3,842,955 to effect adjustment of the individual electromagnet structures relative to the supporting frame of the mosaic needle printer head by a screw adjustment arranged in opposition to a spring biasing element. While such an arrangement provides a very simple axial adjustment of the electromagnetic structure, the position of the electromagnet system relative to the supporting frame is essentially dependent upon the spring element supporting the bearing surface. Tilting moments, occurring during the operation of the electromagneto systems are merely reduced in a cushioned manner, i.e. a firm or braced support is not adequately provided.

BRIEF SUMMARY OF THE INVENTION

The present invention has among its objects the production of an arrangement for mounting electromagnet structures in a mosaic needle printer head, in which a firm support of the magneto structure in the supporting frame of the mosaic needle printer head may be achieved by means of a relatively very simple mounting arrangement, and which also provides a very simple adjustment of the respective magneto structures enabling optimum adjustment of the respective printer needles in relation to the recording carrier.

The desired results are achieved in the present invention by the utilization of a supporting frame structure for the respective electromagnet structures which is provided with respective generally cup-shaped recesses, each of which is adapted to accommodate a electromagnet structure and its associated spring elements.

The use of cup-shaped recesses in the supporting frame of the mosaic needle printer head, as receptacles for the respective electromagnet structure provides bearing surfaces for the latter by means of which they are retained in respective accurately aligned positions, without interfering with the adjustability of the respective structures relative to retaining springs disposed between the structures and the supporting frame. The mounting of the respective electromagnet structures on the supporting frame is particularly simple as the individual components are assembled by a simple interfitting of one with the other and adjustment is not required until the individual components are to be adjusted to their final position, by means of suitable retaining screws.

In a preferred embodiment of the invention, the adjustable supporting or retaining screws are disposed laterally of the respective electromagnet structures, whereby, in the adjustment of the respective electromagnet structures in axial direction, no interfering torques are transmitted thereto, which might, for example, effect an undesirable tensioning or loading of the connections for the electric supply lines to the respective structures. This embodiment may be further improved by providing recesses in a side wall of the cup-shaped frame structure for receipt of a retaining member or strip having its end portions disposed within such recesses and provided with an intermediate arcuate-shaped portion provided with threads thereon cooperable by the threads of the associated adjusting screw, thereby facilitating the construction of the structure for the accommodation and mounting of the respective parts without the utilization of relatively costly machining operations.

In accordance with a further advantageous development of the invention, resilient elements are disposed laterally of the electromagnet structures with such elements positioned in the supporting frame between the associated electromagnet structure and the side wall of the cooperable cup-shaped recess in which it is disposed. With such a construction, the lateral spacing between the electromagnet structure and the opposing portions of the cup-shaped recess of the supporting frame can be spanned by such resilient elements, whereby vibration of the electromagnet structures in the cup-shaped recesses of the supporting frame is effectively prevented by the relatively firm connection provided between the two parts. Advantageously, such resilient elements may be constructed from flat spring stock formed into a generally U-shape, having side or leg portions which extend between the associated electromagnet structure and the opposed walls of the supporting frame.

BRIEF DESCRIPTION OF THE DRAWINGS

In the drawings wherein like reference characters indicate like or corresponding parts.

DETAILED DESCRIPTION OF THE INVENTION

Figure 1:
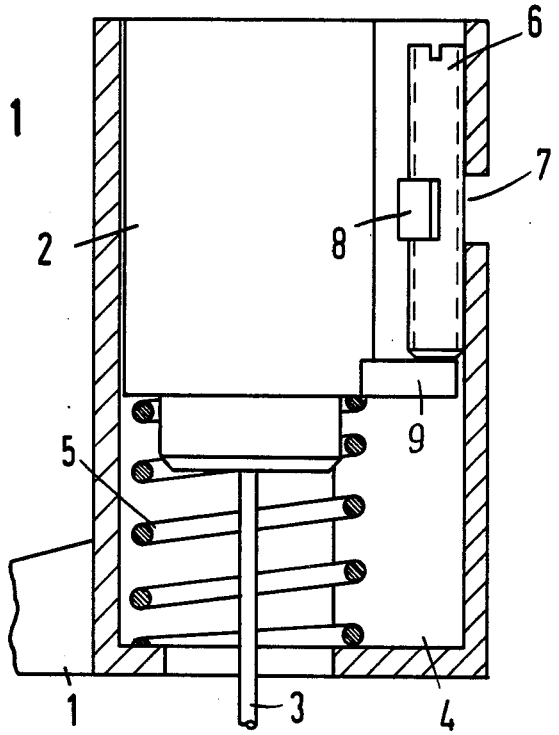
FIG. 1 is a vertical sectional view of a supporting frame and electromagnet structure assembled therewith.
Figure 2:
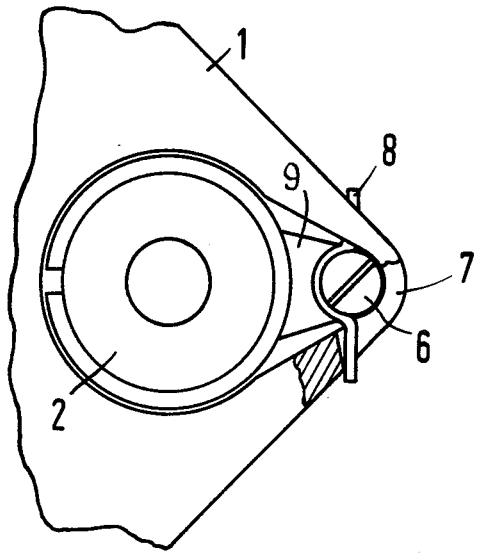
FIG. 2 is a top plan view of the structure illustrated in FIG. 1 with a portion broken away to illustrate details thereof.

Referring to the drawings and particularly to FIGS. 1 and 2, the reference numeral 1 designates generally a supporting member or frame of a mosaic needle printer head, in which is disposed a plunger-type armature electromagnet structure, indicated generally by the numeral 2, adapted to drive a needle 3. Such structures are known, and the details thereof form no part of the present invention. Normally, twelve such electromagnet structures 2 and printer needles 3 would be employed, only one of which is illustrated in the drawings for the purpose of simplicity. The electromagnet structure 2 is supported in a recess 4 of generally cup-shaped configuration which forms a socket for the associated magnet structure and provides lateral support for the structure but at the same time will permit axial or vertical movement, as viewed in FIG. 1. The electromagnet structure 2 is supported, adjacent the bottom portion thereof, by a coil spring 5 which urges the structure 2 upwardly into an abutment formed by the adjacent lower end of a screw 6, which is adapted to bear on a laterally extending projection 9 formed on the structure 2. As clearly illustrated in the drawings, the screw 6 is supported at one side thereof by the adjacent wall of the recess or socket 4 and at the opposite side by a cooperable elongated member or strip 8, having an arcuate intermediate portion which bears on the screw 6 and is provided with threads mating with those of the screw. The strip 8 is provided with substantially aligned, oppositely directed end portions which extend in a slot 7 formed in the adjacent side wall of the frame member. The strip 8 may be formed of semi-resilient metal or the like and may be so shaped that the arcuate portion thereof will apply compression forces to the screw, firmly retaining the latter between the strip and the adjacent side wall of the frame.

The assembly and adjustment of a plunger type armature electromagnet structure 2 in the supporting frame 1 is exceedingly simple. The coil spring 5 and the magneto structure are merely successively inserted into the recess or socket 4, the strip 8 inserted laterally into the slot 7 in the wall of the frame and the screw 6 inserted and screwed down into the assembly. It will be appreciated that by rotating the screw 6 by use of a screwdriver in the slotted end thereof, the electromagnet arrangement may be readily adjusted in axial direction, which operation can be easily accomplished without disturbing any electrical connections, from the rear side of the structure, i.e. that opposite to that associated with the spring 5 and needle 3.

Figure 3:
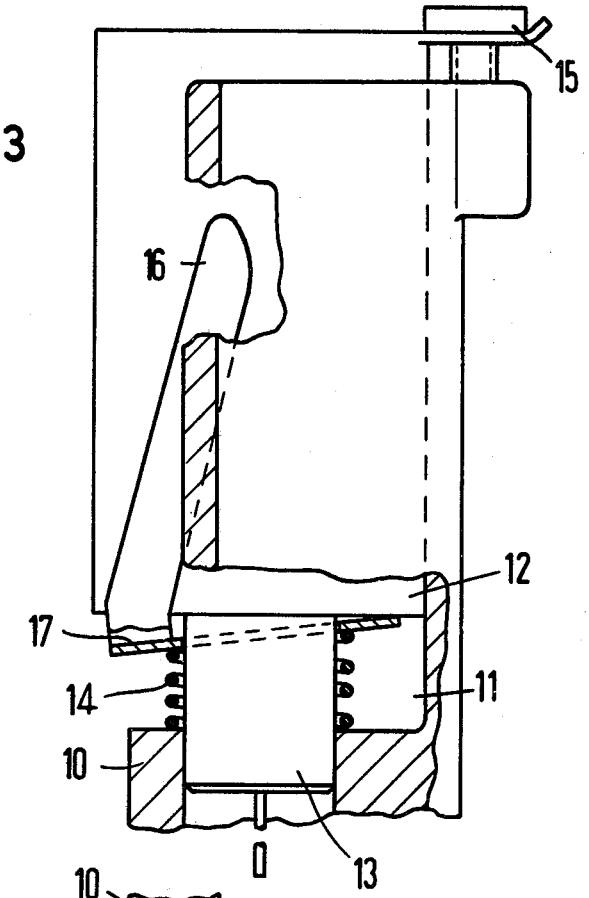
FIG. 3 is a view similar to FIG. 1 illustrating a modified construction of supporting frame and electromagnet structure cooperable therewith.
Figure 4:
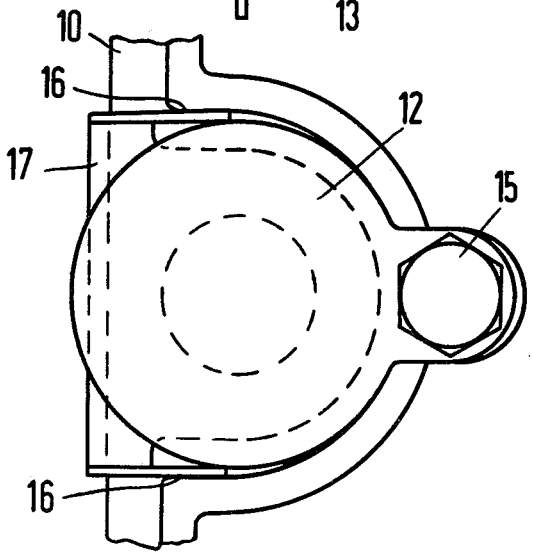
FIG. 4 is a top plan view of the structure illustrated in FIG. 3.

FIGS. 3 and 4 illustrate a further embodiment of the invention in which the recess or socket 11 of the supporting frame 10 is open on one side, with the electromagnet structure 12 being guided by a cylindrical extension 13 which is slidably disposed in a cooperable bore in the supporting frame 10. The electromagnet structure 12 is adapted to be urged upwardly, as viewed in FIG. 3, by a coil spring 14, with movement of the structure being restricted by a screw 15 threaded into a laterally extending projection on the supporting frame 10 and adapted to be engaged by a laterally cooperable tongue or projection extending laterally from the top portion of the structure 12 and bearing on the screw 15. Thus, by adjustment of the screw 15 the axial position of the structure 12, relative to the supporting frame 10, can be achieved.

Disposed between the spring 14 and bottom face of the magneto structure 12 is a spring member 17, formed from strip or sheet stock, having a central aperture through which the extension 13 extends, which spring member is thereby urged upwardly in a clockwise direction, as viewed in FIG. 3, by the spring 14. Extending upwardly from the spring member 17 are a pair of spring arms or leg portion 16 which, as illustrated in FIG. 4, extend into the space between the electromagnet structure 12 and the opposed portions of the supporting frame 10 defining the recess 11. The spring member 17 and its arms 16 thus has a generally U-shaped configuration comprising the leg portions or arms 16, and the apertured intermediate portion, with the spring 14 urging the free ends of the arms 16 into firm engagement with the electromagnet structure and the adjacent side walls of the supporting frame.

As the electromagnet structure 12 is firmly retained in vertical adjusted position by means of the spring 14 and the retaining screw 15, and is further restricted with respect to undesired lateral movement by the spring arms 16, which are firmly urged into the desired engagement by the action of the spring 14 on the aperture portion of the spring member, a very efficient retention of the electromagnet structure in the supporting frame is achieved. At the same time the construction of FIGS. 3 and 4 provide all the other desirable advantages of the construction of FIGS. 1 and 2 with respect to asssembly, adjustment, etc.

Having thus described our invention it will be obvious that although various minor modifications might be suggested by those versed in the art, it should be understood that we wish to embody within the scope of the patent granted hereon all such modifications as reasonably, and properly come within the scope of our contribution to the art.

We claim as our invention:

1. A mounting arrangement for adjustably mounting plunger type electromagnet structures in a mosaic needle printer head, with each structure operable to actuate a cooperable printer needle, comprising a supporting member having a recess therein for each electromagnet structure, of a size to receive such a structure for movement thereof relative to said member along the axis of the cooperable printer needle a distance representing a desired range of adjustment, adjustable abutment means disposed in the path of said structure, limiting axial movement of the latter in one direction, and spring means urging said structure into engagement with said abutment to maintain said electromagnet strucure in adjusted relation in said supporting member, said abutment means being accessible for adjustment from the rear of the electromagnet structure.

2. An arrangement according to claim 1, wherein said abutment means comprises a screw, threaded into a portion of the supporting member.

3. An arrangement according to claim 1, wherein said abutment means comprises a screw which is engaged with a retaining member having an arcuate portion provided with threads thereon cooperable with the threads of said screw, said retaining member having oppositely disposed end portions disposed in retaining recess means formed in said supporting member for retaining said screw in operative position relative thereto.

4. An arrangement according to claim 1, wherein said recess has opposing sidewalls and comprising in further combination, resilient means laterally disposed between each of said electromagnet structures and the adjacent opposing sidewalls of said supporting member defining the associated recess.

5. An arrangement according to claim 4, wherein said resilient means comprises a resilient member having a pair of opposed leg portions and an intermediate portion connecting the same, with said leg portions extending between and engaging the associated electromagnet structure and cooperable sidewalls.

6. An arrangement according to claim 5, wherein said intermediate portion of said resilient member is substantially flat and is disposed between said spring means and the adjacent portion of an associated electromagnet structure whereby said spring means applies forces to said intermediate portion operative to urge the leg portions of said member into engagement with the associated electromagnet structure and cooperable sidewalls.

7. An arrangement according to claim 2, wherein said recess has opposing sidewalls and comprising in further combination, resilient means laterally disposed between each of said electromagnet structures and the adjacent opposing sidewalls of said supporting member defining the associated recess.

8. An arrangement according to claim 7, wherein said resilient means comprises a resilient member having a pair of opposed leg portions and an intermediate portion connecting the same, with said leg portions extending between and engaging the associated electromagnet structure and cooperable sidewalls.

9. An arrangement according to claim 8, wherein said intermediate portion of said resilient member is substantially flat and is disposed between said spring means and the adjacent portion of an associated electromagnet structure whereby said spring means applies forces to said intermediate portion operative to urge the leg portions of said member into engagement with the associated electromagnet structure and cooperable sidewalls.

* * * * *